US008157200B2

(12) United States Patent
Vaughn et al.

(10) Patent No.: US 8,157,200 B2
(45) **Date of Patent: *Apr. 17, 2012**

(54) PROCESS FOR WINDING A WEB MATERIAL

(75) Inventors: Jeffrey Moss Vaughn, Cincinnati, OH (US); Matthew Alan Russell, Monroe, OH (US); Frederick Edward Lockwood, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 389 days.

This patent is subject to a terminal disclaimer.

(21) Appl. No.: 12/508,655

(22) Filed: Jul. 24, 2009

(65) Prior Publication Data

US 2011/0017860 A1 Jan. 27, 2011

(51) Int. Cl.
*B65H 18/22* (2006.01)

(52) U.S. Cl. ..... 242/541.3; 242/535.4; 242/554.3; 242/555.5; 242/559.2

(58) Field of Classification Search ..... 242/541.3, 242/535.4, 554.3, 555.5, 559.2
See application file for complete search history.

(56) References Cited

U.S. PATENT DOCUMENTS

| | | | | |
|---|---|---|---|---|
| 1,040,188 | A | | 10/1912 | Gray |
| 2,769,600 | A | | 11/1956 | Kwitek et al. |
| 3,630,462 | A | | 12/1971 | Nordgren |
| 3,697,010 | A | | 10/1972 | Nystrand |
| 3,791,602 | A | | 2/1974 | Isakson |
| 3,885,749 | A | * | 5/1975 | Skacel ..... 242/420 |
| 4,422,588 | A | | 12/1983 | Nowisch |
| 4,431,140 | A | | 2/1984 | Tetro |
| 4,541,583 | A | | 9/1985 | Forman et al. |
| 4,588,138 | A | | 5/1986 | Spencer |
| 4,687,153 | A | | 8/1987 | McNeil |
| 4,723,724 | A | | 2/1988 | Bradley |
| 4,798,350 | A | | 1/1989 | Jorgensen et al. |
| 4,811,915 | A | | 3/1989 | Smith |
| 4,828,195 | A | | 5/1989 | Hertel et al. |
| 4,856,725 | A | | 8/1989 | Bradley |
| 4,909,452 | A | | 3/1990 | Hertel et al. |
| 4,919,351 | A | | 4/1990 | McNeil |
| 4,955,554 | A | | 9/1990 | LeBoeuf et al. |
| 4,962,897 | A | | 10/1990 | Bradley |
| 4,993,652 | A | | 2/1991 | Moeller |
| 5,104,055 | A | | 4/1992 | Buxton |

(Continued)

FOREIGN PATENT DOCUMENTS

EP 0 291 767 B1 11/1991

(Continued)

*Primary Examiner* — Sang Kim
(74) *Attorney, Agent, or Firm* — Peter D. Meyer

(57) ABSTRACT

A method for rewinding a web material is disclosed. The method comprises the steps of: a) providing a conveyor belt having opposed first and second surfaces; b) providing a pressure assist device proximate to the second surface of the conveyor belt; c) disposing the web material on the first surface of the conveyor belt; d) providing at least one winding spindle having a speed profile proximate to the web material disposed upon the first surface of the conveyor belt; e) adjusting a position of at least one of the conveyor belt and the pressure assist device relative to the winding spindle to provide a compressive force to the surface of the winding spindle by the conveyor belt; f) adjusting a speed of the at least one winding spindle according to the speed profile; and, g) transferring the web material to the at least one winding spindle from the conveyor belt.

18 Claims, 8 Drawing Sheets

U.S. PATENT DOCUMENTS

| | | | | |
|---|---|---|---|---|
| 5,104,155 | A | 4/1992 | Kirkwood | |
| 5,137,225 | A | 8/1992 | Biagiotti | |
| 5,190,232 | A | 3/1993 | Brandon et al. | |
| 5,226,611 | A | 7/1993 | Butterworth et al. | |
| 5,267,703 | A | 12/1993 | Biagiotti | |
| 5,285,979 | A | 2/1994 | Francesco | |
| 5,312,059 | A | 5/1994 | Membrino | |
| 5,335,869 | A | 8/1994 | Yamaguchi et al. | |
| 5,368,252 | A | 11/1994 | Biagiotti | |
| 5,370,335 | A | 12/1994 | Vigneau | |
| 5,402,960 | A | 4/1995 | Oliver et al. | |
| 5,431,357 | A | 7/1995 | Rüegg | |
| 5,497,959 | A | 3/1996 | Johnson et al. | |
| 5,505,405 | A | 4/1996 | Vigneau | |
| 5,538,199 | A | 7/1996 | Biagiotti | |
| 5,542,622 | A | 8/1996 | Biagiotti | |
| 5,565,033 | A | 10/1996 | Gaynes et al. | |
| 5,603,467 | A | 2/1997 | Perini et al. | |
| 5,660,349 | A | 8/1997 | Miller et al. | |
| 5,660,350 | A | 8/1997 | Byrne et al. | |
| 5,667,162 | A | 9/1997 | McNeil et al. | |
| 5,690,297 | A | 11/1997 | McNeil et al. | |
| 5,725,176 | A | 3/1998 | Vigneau | |
| 5,732,901 | A | 3/1998 | McNeil et al. | |
| 5,769,352 | A | 6/1998 | Biagiotti | |
| 5,772,149 | A | 6/1998 | Butterworth | |
| 5,779,180 | A | 7/1998 | Smedt et al. | |
| 5,810,282 | A | 9/1998 | McNeil et al. | |
| 5,839,680 | A | 11/1998 | Biagiotti | |
| 5,845,867 | A | 12/1998 | Hould et al. | |
| 5,899,404 | A | 5/1999 | McNeil et al. | |
| 5,909,856 | A | 6/1999 | Myer et al. | |
| 5,913,490 | A | 6/1999 | McNeil et al. | |
| 5,979,818 | A | 11/1999 | Perini et al. | |
| 6,000,657 | A | 12/1999 | Butterworth | |
| 6,056,229 | A | 5/2000 | Blume et al. | |
| 6,142,407 | A | 11/2000 | McNeil et al. | |
| 6,308,909 | B1 | 10/2001 | McNeil et al. | |
| 6,354,530 | B1 | 3/2002 | Byrne et al. | |
| 6,488,226 | B2 | 12/2002 | McNeil et al. | |
| 6,536,702 | B1 * | 3/2003 | Vargo et al. | 242/530.2 |
| 6,565,033 | B1 | 5/2003 | Biagiotti | |
| 6,595,458 | B1 | 7/2003 | Biagiotti | |
| 6,595,459 | B2 | 7/2003 | Hanson | |
| 6,648,266 | B1 | 11/2003 | Biagiotti et al. | |
| 6,659,387 | B2 | 12/2003 | Biagioni et al. | |
| 6,698,681 | B1 | 3/2004 | Guy et al. | |
| 6,715,709 | B2 | 4/2004 | Stephens et al. | |
| 6,729,572 | B2 | 5/2004 | Baggot et al. | |
| 6,752,344 | B1 | 6/2004 | Biagiotti | |
| 6,752,345 | B2 | 6/2004 | Betti et al. | |
| 6,834,824 | B1 | 12/2004 | Smith | |
| 6,866,220 | B2 | 3/2005 | Sosalla et al. | |
| 7,392,961 | B2 | 7/2008 | McNeil et al. | |
| 7,455,260 | B2 | 11/2008 | McNeil et al. | |
| 7,546,970 | B2 * | 6/2009 | McNeil et al. | 242/533.4 |
| 2002/0130212 | A1 | 9/2002 | Yamasaki | |
| 2003/0226928 | A1 | 12/2003 | McNeil et al. | |
| 2007/0045462 | A1 * | 3/2007 | McNeil et al. | 242/531 |
| 2007/0045464 | A1 * | 3/2007 | McNeil et al. | 242/541.3 |
| 2011/0017859 | A1 * | 1/2011 | Vaughn et al. | 242/521 |

FOREIGN PATENT DOCUMENTS

| | | | |
|---|---|---|---|
| EP | 0 514 226 | A1 | 11/1992 |
| EP | 1 375 402 | A1 | 1/2004 |
| WO | WO 99/02439 | | 1/1999 |
| WO | WO 99/42393 | | 8/1999 |
| WO | WO 01/16008 | A1 | 3/2001 |
| WO | WO 02/055420 | A1 | 7/2002 |
| WO | WO 03/074398 | A2 | 9/2003 |

* cited by examiner

PROCESS FOR WINDING A WEB MATERIAL

FIELD OF THE INVENTION

The present invention relates to processes for winding and rewinding web materials. The present invention particularly relates to processes for winding and rewinding web materials suitable for use by a consumer.

BACKGROUND OF THE INVENTION

Web winders are typically used to form large rolls of wound web material, such as paper and polymeric film materials, known as parent rolls. From the parent rolls, rewinders are employed in order to wind the web material into a rolled product. The rolled product is then cut at designated lengths into the final product. Final products that are typically created by these machines and processes are toilet tissue rolls, paper toweling rolls, paper rolls, polymeric films, and the like.

Known winders for winding a web material into rolls can comprise first and second rollers having a continuous belt disposed about the first and second rollers. A web material is disposed upon at least a portion of the continuous belt. A winding spindle arranged to be rotatably driven about an axis generally parallel to the longitudinal axis of the first and second rollers is adapted to receive the web material when the spindle is proximate to the web material disposed upon the continuous belt. At least one of the longitudinal axis of the first roller and the longitudinal axis of the second roller is adjustable relative to the winding spindle. A web separator can be adapted to periodically pinch the web material between the web separator and the belt when the peripheral speed of the web separator and the speed at which the web material is moving are different. The winding spindle may be operatively mounted upon a winding turret that is indexable about a winding turret axis through an endless series of indexed positions. Such an exemplary winder is disclosed in U.S. Pat. No. 7,392,961.

One affect of such a disclosed winder is that the continuous belt disposed about the first and second rollers is the elastic nature of such a belt. It can be seen from operation that the continuous belt may tend to conform to the outer surface of the web being wound about the spindle. In such a situation, the force of the belt being exerted upon the web material being disposed about the winding spindle and the winding spindle itself is dispersed over a large area resulting in a lowering of the force applied to the web material being disposed about the winding spindle and the winding spindle itself per unit area. In situations where it is desired to maximize the force applied to the web material being disposed about the winding spindle and the winding spindle itself at the point of transfer of the web material from the continuous belt to the winding spindle such a situation may lead to inconsistent force, or even less than desired force, being applied.

Thus, it is desired to localize the forces being applied to web material being disposed about the winding spindle and the winding spindle itself. This requires providing such a winder with the ability to provide such force to a web material being disposed about the winding spindle and the winding spindle itself. As will be appreciated by one of skill in the art, this capability, when coupled with known capabilities for imparting perforations at desired intervals and sheet counts in increments of 1, can provide for a greatly enhanced product converting flexibility. This, in turn, can allow multiple finished product designs to be achieved using a common substrate. This can also provide substantial manufacturing expense savings by reducing changeovers on paper machines and converting lines, avoiding multiple parent roll inventories, and the like. Such a desired hybrid winding system can also provide the capability to wind thick, highly embossed web materials into preferred high density finished product rolls having low sheet tension. As will soon be appreciated by one of skill in the art, this can improve product quality by eliminating sheet elongation and embossment distortion as well as improving winding reliability by providing fewer web material feed breaks in the winding process.

SUMMARY OF THE INVENTION

The present disclosure provides for an improved process for rewinding a web material. The process comprises the steps of: a) providing a conveyor belt having opposed first and second surfaces; b) providing a pressure assist device proximate to the second surface of the conveyor belt; c) disposing the web material on the first surface of the conveyor belt; d) providing at least one winding spindle having a speed profile proximate to the web material disposed upon the first surface of the conveyor belt; e) adjusting a position of at least one of the conveyor belt and the pressure assist device relative to the winding spindle in order to provide a compressive force to the surface of the winding spindle by the conveyor belt; f) adjusting a speed of the at least one winding spindle according to the speed profile; and, g) transferring the web material to the at least one winding spindle from the conveyor belt.

Another embodiment of the present disclosure provides for an improved process for winding web material comprising the steps of: a) providing a conveyor belt, the conveyor belt having opposed first and second surfaces; b) providing a pressure assist device proximate to the second surface of the conveyor belt; c) providing a first winding spindle having a speed profile adjacent to the first surface of the conveyor belt; d) transferring the web material to the first surface of the conveyor belt; e) adjusting a position of at least one of the conveyor belt and the pressure assist device relative to the winding spindle in order to provide a compressive force to the surface of the winding spindle by the conveyor belt; f) subsequently transferring the web material from the first surface of the conveyor belt to the first winding spindle; g) adjusting the speed of the first winding spindle according to the speed profile; and, h) disposing the web material upon the first winding spindle to produce a finally wound product.

Yet another embodiment of present disclosure for an improved process for winding web material comprises the steps of: a) providing a conveyor belt having a first surface and a second surface opposed thereto; b) providing a pressure assist device in contacting engagement with the second surface of the conveyor belt; c) depositing the web material onto the first surface of the conveyor belt; d) moving the web material deposited upon the first surface of the conveyor belt proximate to a winding spindle having a speed profile; e) adjusting a position of at least one of the conveyor belt and the pressure assist device relative to the winding spindle in order to provide a compressive force to the surface of the winding spindle by the first surface of the conveyor belt; f) rotating the winding spindle according to the speed profile; and, g) transferring the web material from the first surface of the conveyor belt to the winding spindle.

DETAILED DESCRIPTION OF THE INVENTION

In the prior art, a winder or reel is typically known as a device that performs the very first wind of that web material, generally forming what is known as a parent roll. A rewinder, on the other hand, is generally known as a device that winds the web material from the parent roll into a roll that is essentially the finished product. For purposes of the present application, the words 'winder' and 'rewinder' are interchangeable with one another in assessing the scope of the claims.

The term machine direction (MD) is known to those of skill in the art as the direction of travel of a web material through any processing equipment. The cross-machine direction (CD) is orthogonal and coplanar thereto. The Z-direction is orthogonal to both the machine and cross-machine directions.

Figure 1:
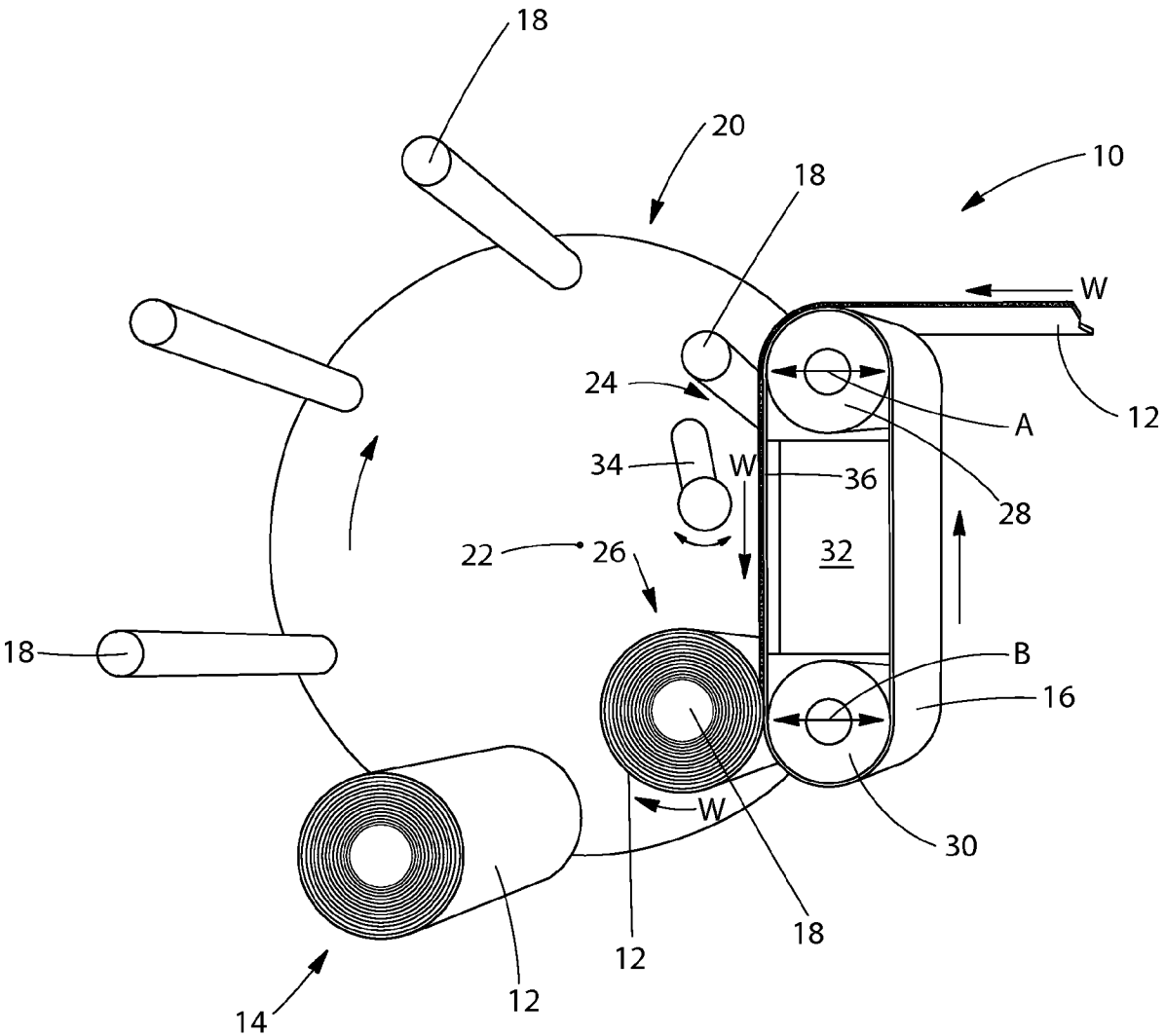
FIG. 1 is a perspective view of an exemplary embodiment of an improved hybrid winder in accordance with the present invention.

Referring now to the drawings, FIG. 1 shows an exemplary hybrid winder 10 in accordance with the present invention. The hybrid winder 10 is suitable for use in winding a web material 12 to produce a final wound product 14. The final wound product 14 that may be produced by the hybrid winder 10 of the present invention can be any number of types of products such as hand towels, toilet tissue, paper towels, polymeric films, trash bags, and the like. As such, web material 12 can comprise continuous web materials, discontinuous web materials comprising interleaved web segments, combinations thereof, and the like. Exemplary materials suitable for web material 12 of the present invention include, without limitation, metal foils, such as aluminum foil, wax paper or grease-proof paper, polymeric films, non-woven webs, fabrics, paper, combinations thereof, and the like. The web material 12 is shown as being transported by the hybrid winder 10 in the direction indicated by the arrow W. The hybrid winder 10 transports the web material 12 by use of a conveyor belt 16 supported by first conveyor roller 28 and second conveyor roller 30.

The web material 12 is transported by the conveyor belt 16 into winding contact with at least one winding spindle 18. In a preferred embodiment, a plurality of winding spindles 18 are disposed upon a winding turret 20 indexable about a center shaft thereby defining a winding turret axis 22. The winding turret 20 is preferably indexable, or moveable, through an endless series of indexed positions. For example, a first winding spindle 24 can be located in what may be conveniently called an initial transfer position and a second winding spindle 26 can be located in what may conveniently be called a final wind position. In any regard, the winding turret 20 is indexable from a first index position into a second index position. Thus, the first winding spindle 24 is moved from the initial transfer position into the final wind position. Such indexable movement of the first winding spindle 24 disposed upon winding turret 20 may comprise a plurality of discrete, defined positions or a continuous, non-discrete sequence of positions. However, it should be appreciated that winding spindle 18 can be brought into proximate contact with conveyor belt 16 by any means known to one of skill in the art. Exemplary, but non-limiting, turrets suitable for use with the present invention (including 'continuous motion' turrets) are disclosed in U.S. Pat. Nos. 5,660,350; 5,667,162; 5,690,297; 5,732,901; 5,810,282; 5,899,404; 5,913,490; 6,142,407; and 6,354,530. As will also be appreciated by one of skill in the art, the so-called open-loop turret systems would also be suitable for use as a support for the disposition and movement of winding spindles 18 used in accordance with the present invention. An exemplary, but non-limiting, open-loop turret system is disclosed in WO 03/074398.

A pressure assist device 32 is preferably disposed adjacent the inwardly facing surface of conveyor belt 16 between and proximate to first conveyor roller 28 and second conveyor roller 30. It is preferred that pressure assist device 32 be positioned in order to support conveyor belt 16 as conveyor belt 16 contacts winding spindle 18.

It was surprisingly found in certain embodiments that conveyor belt 16 tended to deflect away from winding spindle 18 when conveyor belt 16 was engaged with winding spindle 18. In other words, as first conveyor roller 28 and second conveyor roller 30 were positioned to engage conveyor belt 16 with winding spindle 18 so that conveyor belt 16 was applying pressure to winding spindle 18, conveyor belt 16 tended to conform to the surface of winding spindle 18 and any web material 12 disposed thereabout increased. As the total surface area of conveyor belt 16 that was conformably disposed about winding spindle 18 and any web material 12 disposed thereabout, the desired pressure per unit area at the point where web material 12 transferred from the surface of conveyor belt 16 to the winding spindle 18 decreased.

Thus, the surprising solution was to provide for a pressure assist device 32 with hybrid winder 10. It was surprisingly found that pressure assist device 32 reduced the deformation of conveyor belt 16 away from winding spindle 18. This allowed conveyor belt 16 to be moved relative to winding spindle 18 by movement of first conveyor roller 28 and second conveyor roller 30 relative to winding spindle 18 in order to more accurately apply the desired amount of pressure upon winding spindle 18 more precisely. It was also surprisingly found that the incorporation of pressure assist device 32 with hybrid winder 10 could facilitate the application of pressure, or force, upon winding spindle 12 in better conformity with a desired wind profile of a final wound product 14.

Figure 2:
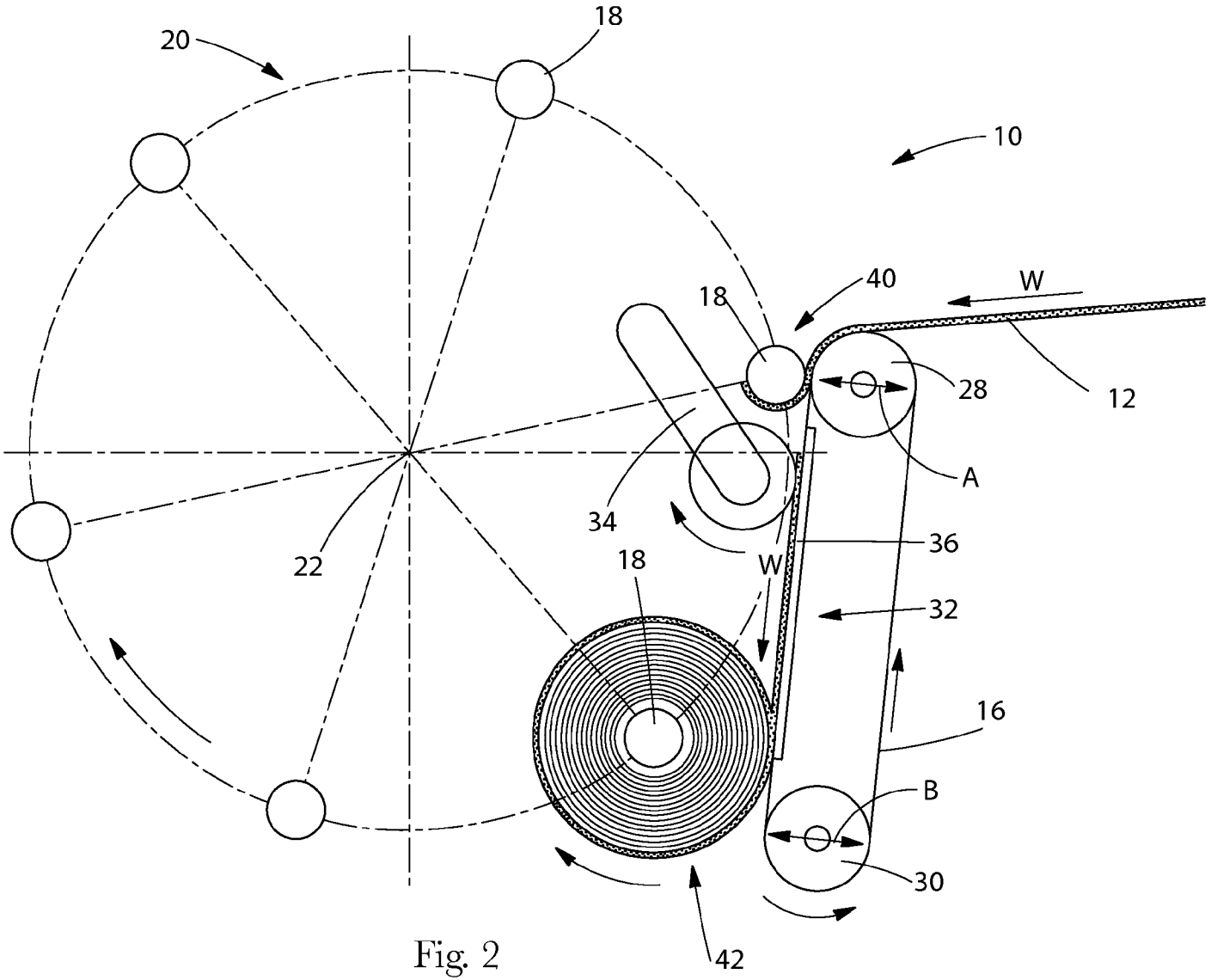
FIG. 2 is a cross-sectional view of the improved hybrid winder of FIG. 1.

As shown in FIGS. 1 and 2, pressure assist device 32 could be provided by one of skill in the art as a flat plate 36. Such a flat plate 36 could be fixably mounted relative to first conveyor roller 28 and second conveyor roller 30 and the inside of conveyor belt 16 according to methods known to those of skill in the art. Alternatively, pressure assist device 32 could move relative to first conveyor roller 28, second conveyor roller 30 and/or conveyor belt 16 by the use of a positioning device (not shown), such as linear actuators, servo motors, cams, links, and the like known by those of skill in the art as useful for such a result, to control of the position of pressure assist device 32 relative to conveyor belt 16. Suitable positioning devices (not shown) associated with pressure assist device 32 should preferably be capable of moving either end of pressure assist device 32 relative to conveyor 16 generally parallel to the Z-direction relative to web material 12 as web material 12 passes proximate to, and in eventual contacting engagement with, winding spindle 18. Either the leading edge or trailing edge of pressure assist device 32 is preferably positionable either jointly or severally. However, it should be realized that pressure assist device 32 can have a respective axis in virtually any direction required to provide the required contact clearance, and/or pressure between the conveyor belt 16 and the log associated with second winding spindle 26. In other words, the pressure assist device 32 provides a surface for conveyor belt 16 to traverse so that the web material 12 disposed upon conveyor belt 16 is transferred from the outwardly facing surface of conveyor belt 16 to winding spindle 18 at a point that is tangent to the circumference of winding spindle 18.

In such an embodiment as shown in FIGS. 1 and 2, it can be preferred to provide the surface of pressure assist device 32 contacting the inwardly facing surface of conveyor belt 16 as a surface having reduced friction in order to extend conveyor belt 16 life. Manners and processes of providing a reduced friction surface would be known to those of skill in the art of reducing the frictional forces of contacting surfaces. Such methods may incorporate the application of lubricants to the surface of pressure assist device 32. Another embodiment may provide for the incorporation and/or deposition of materials having known low coefficients of friction upon the surface of pressure assist device 32. Yet another embodiment to reduce frictional forces may provide for the application and/or injection of air into the interstice formed between the outwardly facing surface of pressure assist device 32 and conveyor belt 16. Still yet another embodiment to reduce frictional forces may provide for the provision of pressurized air to be emitted from the surface of pressure assist device 32 from the interior of pressure assist device 32 through a plurality of holes connecting the interior of pressure assist device 32 and the outer surface of pressure assist device 32 that contacts conveyor belt 16. In a preferred embodiment, the tension of conveyor belt 16 could be minimized to reduce any resulting frictional forces disposed upon pressure assist device 32. In any regard, one of skill in the art should recognize that the tension in conveyor belt 16 should be both necessary and sufficient to preclude slippage between first conveyor roller 28 and conveyor belt 16 as well as between second conveyor roller 30 and conveyor belt 16.

Figure 3:
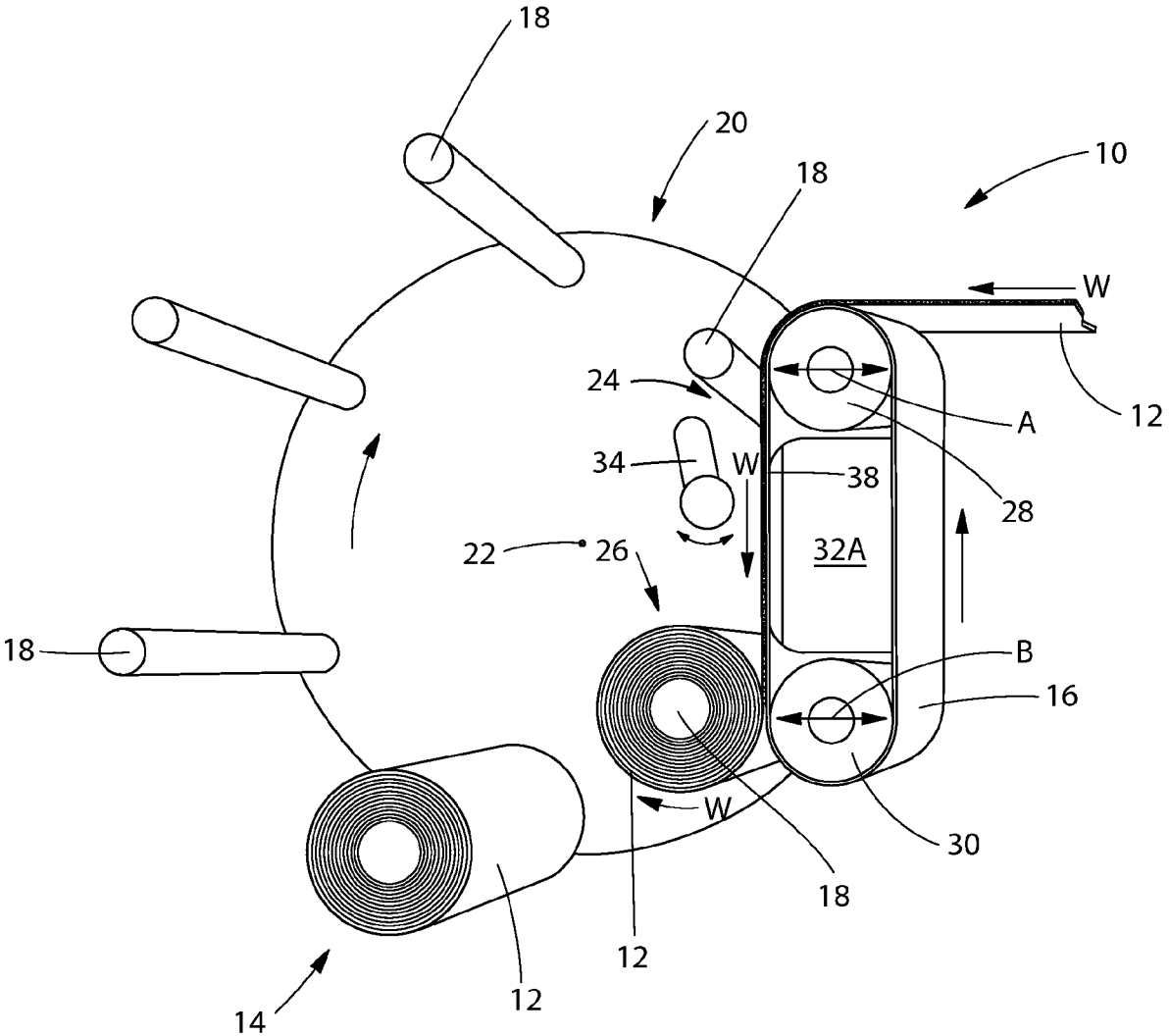
FIG. 3 is a perspective view of an alternative embodiment of an improved hybrid winder.
Figure 4:
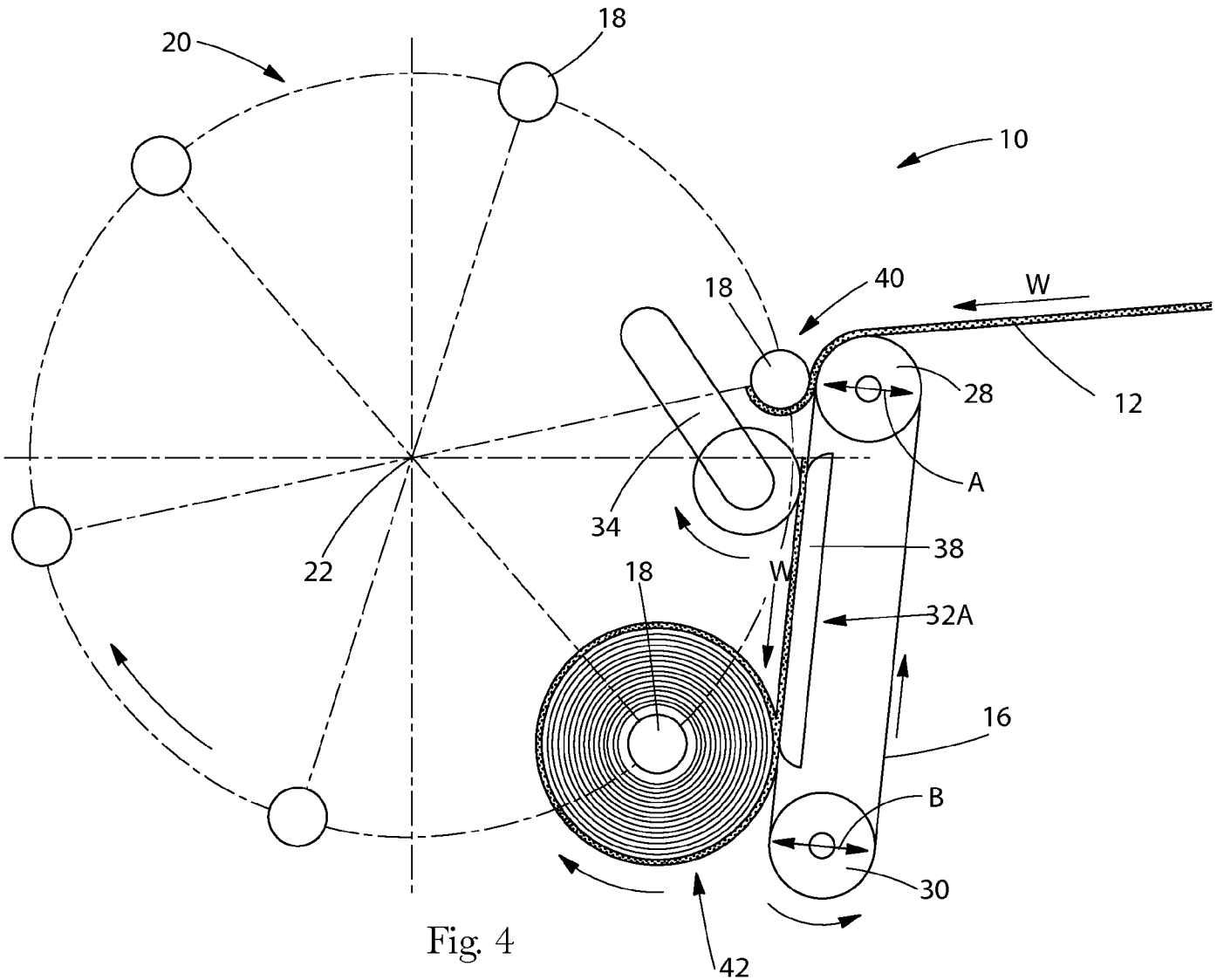
FIG. 4 is a cross-sectional view of the improved hybrid winder of FIG. 3.

As shown in FIGS. 3 and 4, hybrid winder 10A incorporates a pressure assist device 32A provided as a plate having chamfered trailing and/or leading edges 38. It was surprisingly found that providing pressure assist device 32 in the form of a plate having chamfered trailing and leading edges 38 significantly increased conveyor belt 16 life by reducing the opportunity for imperfections present upon the conveyor belt 16 from impacting a hard trailing and/or leading edge present upon pressure assist device 32A.

It should be recognized that a pressure assist device 32A having a chamfered leading edge can also provide some degree of compliance in conveyor belt 16 generally parallel to the Z-direction relative to web material 12 as web material 12 passes proximate to a winding spindle 18. This compliance in conveyor belt 16 was surprisingly found to improve the reliability of transferring sheet material 12 to the winding spindle 18 as it provides a manner to accommodate any vibrations that may be associated with the rotation of a winding spindle 18. A pressure assist device 32A having a chamfered leading edge has also been found to improve the life of conveyor belt 16 by reducing the wear associated with any core locking pins that may protrude beyond the circumferential surface of winding spindles 18 and are compressively forced into the surface of conveyor belt 16.

In a preferred but non-limiting embodiment, pressure assist device 32 is positioned so that it displaces conveyor belt 16 toward sheet material 12 and winding spindle 18 beyond the tangent line that conveyor belt 16 would normally define due to tension alone between the circumferential surface of conveyor roller 28 and the circumferential surface of conveyor roller 30. It has been found that positioning pressure assist device 32 in such a manner can maintain conveyor belt 16 with a generally flat orientation across its entire width. This has been surprisingly found to enhance the uniformity of contact between conveyor belt 16 and web material 12 as web material 12 winds about winding spindle 18. It should also be realized by one of skill in the art that the surface of pressure assist device 32A contacting conveyor belt 16 can be provided as a curvilinear surface forming an arc of a circle (or a hyperbola) in the MD direction. It was surprisingly found that providing the surface of pressure assist device 32A that contacts conveyor belt 16 with such a curvature can provide compliancy of the pressure assist device 32A with any chamfered leading and/or trailing edges provided to pressure assist device 32A. This was found to facilitate loading of the winding spindle 18 relative to the conveyor belt 16 or loading of the conveyor belt 16 relative to the winding spindle 18 at the point of initial transfer of web material 12 to winding spindle 18 at the beginning of the winding process, without requiring pressure assist device 32A to contact conveyor belt 16.

It was also surprisingly found that by providing the surface of pressure assist device 32A that contacts conveyor belt 16 as an arc or a hyperbolic surface, the final wound product 14 could be provided with more consistency from one final wound product 14 to the next final wound product 14. That is to say that the final wound product 14 from one log to the next shows little variation in the physical properties associated with winding a web material 12 into a final wound product 14 for a given desired wind profile. In other words, the resulting wind profile of one final wound product 14 to the next final wound product 14 are nearly the same or are very similar. Stated another way, by providing the surface of pressure assist device 32A that contacts conveyor belt 16 with a given curvature incorporating any chamfered leading and/or trailing edges can provide for the determination of a wind profile (or algorithm) that can be more easily defined to incorporate the entire length of the pressure assist device 32A. Without desiring to be bound by theory, it is believed that this is because the pressure assist device 32A so configured does not incorporate any edges or surface transitions. The surface of pressure assist device 32A contacting conveyor belt 16 is preferably provided as a smooth and continuous surface.

Figure 5:
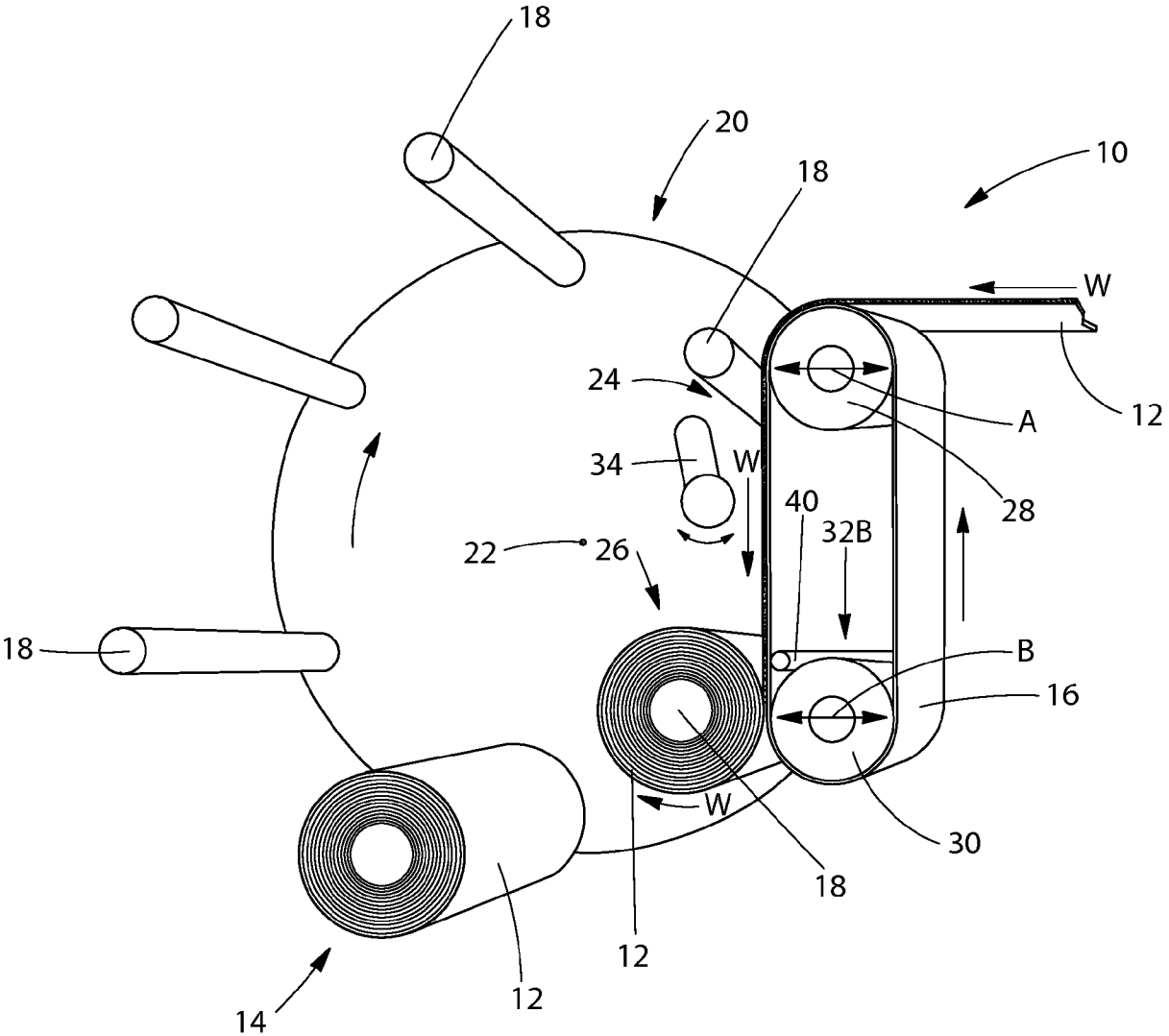
FIG. 5 is a perspective view of yet another alternative embodiment of an improved hybrid winder.
Figure 6:
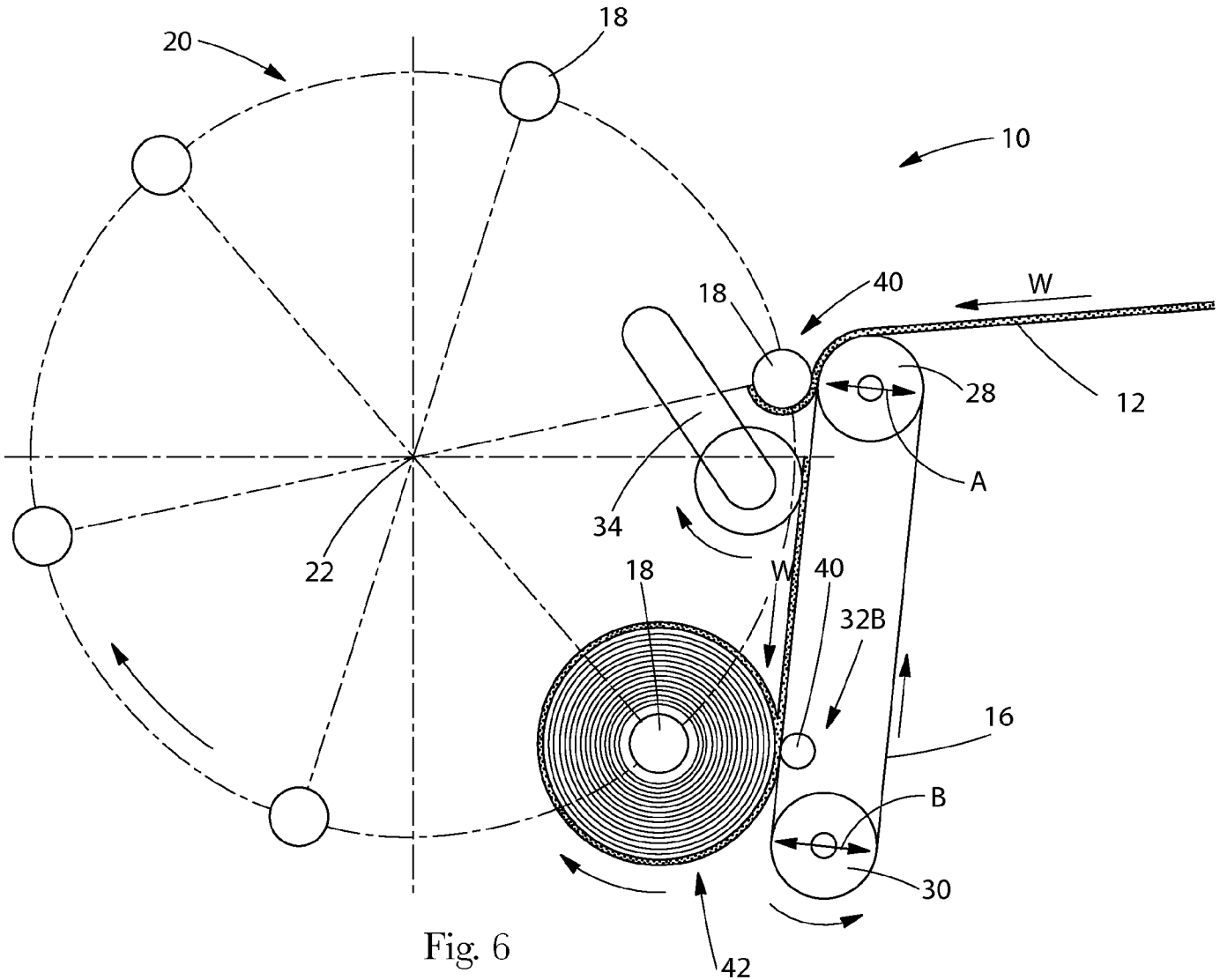
FIG. 6 is a cross-sectional view of the improved hybrid winder of FIG. 5.

As shown in FIGS. 5 and 6, hybrid winder 10B incorporates a pressure assist device 32B provided as a belt roller 40. In such an instance, since winding spindle 18 is moveable within the hybrid winder 10B, pressure assist device 32B necessarily must follow winding spindle 18 from the point of engagement with web material 12 until the final portion of web material 12 is disposed upon winding spindle 18. Thus, one of skill in the art will readily realize that pressure assist device 32B in the form of a belt roller 40 should be provided with the ability to follow winding spindle 18 as it traverses hybrid winder 10B. Such methods may incorporate the use of a track or cam follower path that facilitates belt roller 40 progress along the surface of conveyor belt 16 disposed away from winding spindle 18. Additionally, one of skill in the art will readily appreciate that belt roller 40 can be passively rotated with the movement of conveyor belt 16 or provided with an independent means of rotation.

Figure 7:
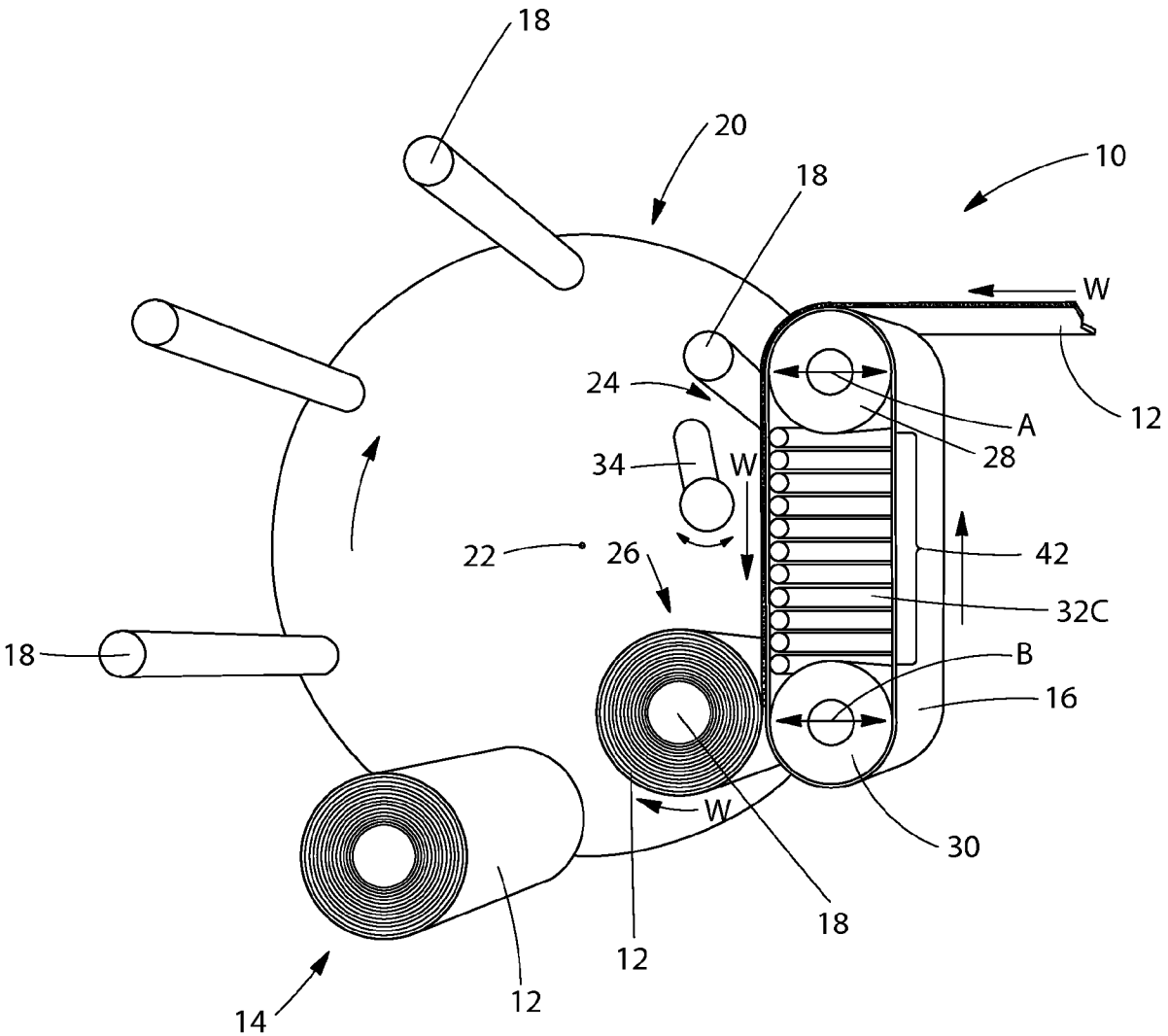
FIG. 7 is a perspective view of still another alternative embodiment of an improved hybrid winder; and, FIG. 8 is a cross-sectional view of the improved hybrid winder of FIG. 7.
Figure 8:
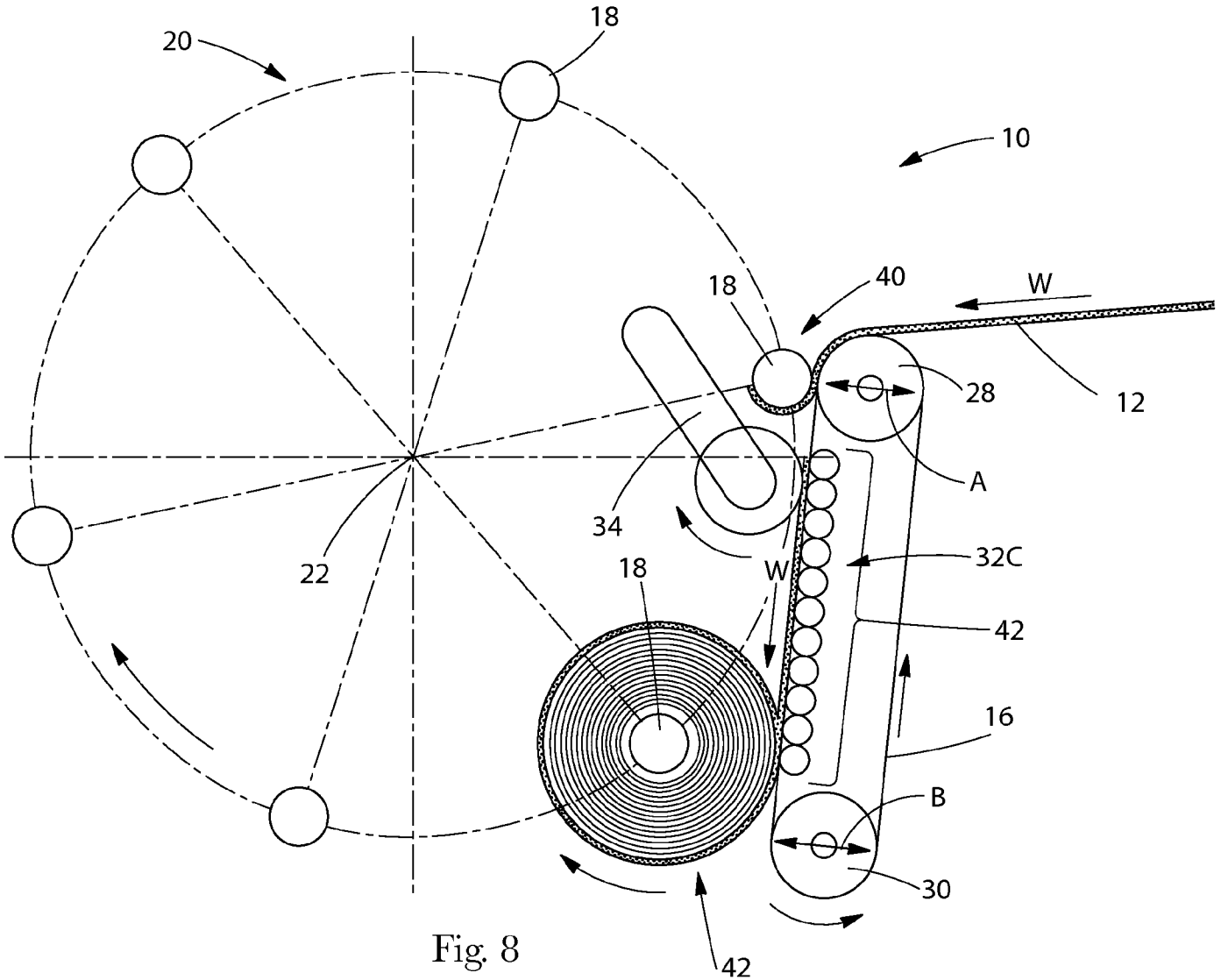

As shown in FIGS. 7 and 8, hybrid winder 10C incorporates a pressure assist device 32C provided as a plurality of belt rollers 42. In such an instance, since winding spindle 18 is moveable within the hybrid winder 10C, pressure assist device 32C in the form of a plurality of belt rollers 42 can effectively allow winding spindle 18 with web material 12 disposed thereabout to follow successive points of engagement and disengagement with each successive roller of the plurality of belt rollers 42 until the final portion of web material 12 is disposed upon winding spindle 18. Additionally, one of skill in the art will readily appreciate that each roller of the plurality of belt rollers 42 can be passively rotated with the movement of conveyor belt 16 or provided with an independent means of rotation.

One of skill in the art would easily recognize that pressure assist device 32 can take on virtually any form including that of an inflatable bladder (not shown). In such an instance an inflatable bladder is preferably disposed proximate to the inwardly facing surface of conveyor belt 16. One of skill in the art would understand that such a bladder could be pressurized with a gas or a fluid. Adjustment of the internal pressure of the bladder could control the contact force between the conveyor belt 16, the web material 12, and/or winding spindle 18.

Returning again to FIG. 1, if so desired by the practitioner, the conveyor belt 16 may be provided with a relieved surface. In such an embodiment, the relieved portions can be provided as a pattern disposed upon, or within, the material comprising conveyor belt 16. Such a pattern may be disposed upon, or otherwise associated with conveyor belt 16 by laser engraving, mechanical implantation, polymeric curing, or the like. In an exemplary, but non-limiting embodiment, such a pattern, relieved or otherwise, may correspond to any indicia, embossments, topography pattern, adhesive, combinations thereof, and the like, that are disposed upon, or disposed within, web material 12. It is believed that such an exemplary pattern associated with conveyor belt 16 may be registered with respect to any direction, or directions, of web material 12, particularly the machine- and/or the cross-machine directions of web material 12. Such a pattern can be associated with conveyor belt 16 and can be provided relative to any indicia, embossments, topography pattern, combinations thereof, or the like, associated with web material 12 by any means known to one skilled in the art. Such an embodiment may be useful in preserving desirable features in the web material 12 such as embossments, or may provide a desired contact force, such as for improved bonding force in areas of a two-ply, or other multiple-ply, product comprising adhesive for joining one ply to another. Similarly, the conveyor belt 16 can be provided with embossments and/or any other type of topography pattern corresponding to the portions of a multi-ply type of web material 12 that may have an adhesive or other bonding formulation or structure disposed between the plies forming web material 12. A conveyor belt 16 provided with such embossments and/or any other type of topography pattern can provide for better adhesion and/or bonding of the plies forming web material 12 by providing additional pressure to the region sought to be so bonded as would be known to one of skill in the art. It is believed that such increased bonding can be useful for the prevention of so-called 'skinned' rolls wherein the plies of a multiple-ply final rolled product 14 separate during dispensing by the consumer. This is known to those of skill in the art as an undesirable quality defect.

In a preferred embodiment of the present invention, the conveyor belt 16 is driven at a surface speed that corresponds to the speed of the incoming web material 12. A positioning device (not shown), such as linear actuators, servo motors, cams, links, and the like known by those of skill in the art as useful for such a result, are provided for control of the position of first conveyor roller 28 and second conveyor roller 30 supporting conveyor belt 16. Thus, a positioning device (not shown) associated with first conveyor roller 28 is preferably capable of moving first conveyor roller 28 along axis A. In such a preferred embodiment, axis A is generally parallel to the Z-direction relative to web material 12 as web material 12 passes proximate to a winding spindle 18. Likewise, a positioning device (not shown) associated with second conveyor roller 30 is preferably capable of adjusting the position of second conveyor roller 30 along axis B. In a preferred embodiment, axis B is preferably generally parallel to the Z-direction relative to web material 12 as web material 12 passes proximate to a winding spindle 18. It is believed that in this way, the position of first conveyor roller 28 and second conveyor roller 30, when combined with the known diameter growth of the log associated with second winding spindle 26, can provide the required contact, clearance, and/or pressure between the conveyor belt 16 and the log associated with second winding spindle 26. However, it should be realized that first conveyor roller 28 and second conveyor roller 30 can have a respective axis A, B in virtually any direction required to provide the required contact or clearance between the conveyor belt 16 and the log associated with second winding spindle 26. Likewise, first conveyor roller 28 and second conveyor roller 30 can have virtually any number of axes (i.e., at least one) associated thereto as required in order to provide the required contact or clearance between the conveyor belt 16 and the log associated with second winding spindle 26.

Optionally, either of the first conveyor roller 28 and the second conveyor roller 30 can be maintained in a fixed position relative to winding spindle 18. In such an embodiment, the other conveyor roller of either of the first conveyor roller 28 and the second conveyor roller 30 would be pivotably, or orbitally, moveable relative to the chosen, fixed conveyor roller. By way of example both of first conveyor roller 28 and second conveyor roller 30 can be fixably mounted to a hinged, flat plate. Such a hinged, flat plate can be provided with a force (such as through a spring, linear actuator, servo motor, cam, link, and the like) at a location distal from a point fixably positioned relative to a winding spindle 18. Such a force applied to the hinged structure could provide for a tighter wind profile for final wound product 14.

If contact between conveyor belt 16 through web material 12 to the log associated with second winding spindle 26 is desired, the position of first conveyor roller 28 and second conveyor roller 30, along exemplary axis A and B respectively, can be controlled to a known position in order to provide the desired contact, or clearance, between the conveyor belt 16 and the log associated with second winding spindle 26 throughout the entire wind, if required. Maintaining the desired contact, or clearance, throughout the entire wind may be particularly advantageous when winding products having higher densities. Maintaining contact throughout the wind, in such an instance is believed to facilitate compaction of all layers of web material 12 within the wound product roll, thereby providing maximum potential density. Maintaining contact throughout the entire wind is also believed to improve product consistency when the web material 12 comprises a structure that is affected by contact force against the conveyor belt 16. By way of example, embossed areas disposed upon web material 12 may have a different appearance or thickness in a region contacted by the conveyor belt 16 compared to an area not so contacted by conveyor belt 16.

In a preferred, but non-limiting, embodiment the first conveyor roller 28 and the second conveyor roller 30 are controlled to provide a contact force between the conveyor belt 16 and the web material 12 at a point that is substantially aligned with the tangent point between the incoming web material 12 and the material disposed about winding spindle 26 and/or winding spindle 26. In a more preferred embodiment, this alignment between the contact force and tangent point of incoming web material 12 is maintained throughout the entirety of the winding process for each wound product roll.

Alternatively, the position of first conveyor roller 28 and second conveyor roller 30 can be positioned along axis A and B respectively in order to regulate the contact force between the conveyor belt 16 and the log associated with second winding spindle 26. By way of example, in order to provide a low density product roll design upon final wound product 14, there may be minimal or even no, contact between the conveyor belt 16 and the log associated with second winding spindle 26. For medium density product roll designs in final wound product 14, there may be moderate contact, or force, between the conveyor belt 16 and the log associated with second winding spindle 26. For providing high density product roll designs in final wound product 14, there may be relatively high contact, or force, between the conveyor belt 16 and the log associated with second winding spindle 26. In any regard, it is preferred that the rotational speed of the winding spindles 18 be controlled in order to decelerate at a rate that maintains the same winding surface speed, or desired speed differential, as the diameter of the log associated with second winding spindle 26 increases.

As shown in FIG. 1, the hybrid winder preferably provides a turret 20 supporting a plurality of winding spindles 18. The winding spindles 18 preferably engage a core (not shown) upon which the web material 12 is wound. The winding spindles 18 are driven in a closed spindle path about the winding turret 20 assembly central axis 22. Each winding spindle 18 extends along a winding spindle 18 axis generally parallel to the winding turret 20 assembly winding turret axis 22, from a first winding spindle 18 end to a second winding spindle 18 end. The winding spindles 18 are preferably supported at their first ends by the winding turret 20 assembly. The winding spindles 18 are preferably releasably supported at their second ends by a mandrel cupping assembly (not shown). The winding turret 20 preferably supports at least three winding spindles 18, more preferably at least six winding spindles 18, and in one embodiment the turret assembly 20 supports ten winding spindles 18. As would be known to one of skill in the art, a winding turret assembly 20 supporting at least 10 winding spindles 18 can have a rotatably driven winding turret 20 assembly which is rotated at a relatively low angular velocity to reduce vibration and inertial loads, while providing increased throughput relative to indexing a winding turret 20 which is intermittently rotated at higher angular velocities. Exemplary winding turret assemblies suitable for use with the present invention are disclosed in U.S. Pat. Nos. 5,690,297 and 5,913,490.

A perforator roll, anvil, or any other non-contact perforation devices known by those of skill in the art (not shown) can be adapted to provide lines of perforations extending along the cross-machine direction of the web material 12. Adjacent lines of perforations are preferably spaced apart at a predetermined distance along the length of the web material 12 to provide individual sheets of web material 12 that are joined together at the perforations. The sheet length of the individual sheets of web material 12 is the distance between adjacent lines of perforations.

Once the desired number of sheets of web material 12 has been wound into the log associated with second winding spindle 26, in accordance with the present invention, a web separator 34 can be moved into position proximate to web material 12 disposed upon conveyor belt 16 in order to provide separation of adjacent sheets of perforated web material 12. The web separator 34 can be provided as a rotary unit shearing apparatus known to those of skill in the art useful for the severance of the web material 12 into individual sheets. In a preferred embodiment, the web separator 34 cooperates with the surface of conveyor belt 16 upon which web material 12 is disposed. In a preferred embodiment, web separator 34 is provided as a continuous speed roll moved intermittently and/or periodically into contact with the web material 12 disposed upon conveyor belt 16. Alternatively, a suitable web separator 34 for the present invention can be provided with a semi-continuous speed roll that is constantly in contact with web material 12 disposed upon conveyor belt 16. Such a semi-continuous speed roll can be provided with momentary periods of acceleration or deceleration. Yet still, the web separator 34 can be a contacting arm provided with a smooth rubber surface and/or pressers, or pads, intended to exert a pressure, through a slight interference, against the surface of the conveyor belt 16. In such an embodiment, the web separator 34 preferably rotates intermittently, in a clockwise direction; however, the web separator 34 may be provided with a pendulum-like oscillatory movement. The pressers or pads disposed upon web separator 34 preferably move along a circular path which has an axis coincident with the axis of rotation of the web separator 34 and almost tangent to (or making a slight interference with) the surface of the conveyor belt 16 comprising hybrid winder 10.

Once the desired number of sheets of web material 12 has been wound into the log associated with second winding spindle 26, the web separator 34 is moved (i.e., pivoted) into a position which facilitates a nip between a roller, a presser, or pad, associated with the web separator 34 and the conveyor belt 16 upon which web material 12 traverses. The movement of the web separator 34 is timed such that the web separator 34 nips the web material 12 against the conveyor belt 16 when the perforation at the trailing end of the last desired sheet for the log associated with second winding spindle 26 is located between the first, or new, winding spindle 24 at the transfer position (i.e., at the web material 12 nip point) and the web separator 34 surface when it contacts the conveyor belt 16.

Additionally, the portion of web separator 34 that forms the nip against the conveyor belt 16 can have a surface speed that is either less than, the same as, or greater than, the surface speed of the conveyor belt 16 and the web material 12 cooperatively associated thereto. In a preferred embodiment, the web separator 34 is provided with a surface speed greater than that of the surface speed of the conveyor belt 16 and the web material 12 cooperatively associated thereto. Without desiring to be bound by theory, it is believed that if the conveyor belt 16 is provided with a low coefficient of friction and the web separator 34 is provided with a surface speed greater than that of conveyor belt 16, the web separator 34 effectively accelerates the web material 12 at the nip point because the web material 12 slips relative to the conveyor belt 16 traveling at the desired web material 12 winding speed. Concurrent with such over-speed nip formation between web separator 34 and conveyor belt 16, a succeeding new winding spindle 18 that will form the log associated with first winding spindle 24, traveling at the same surface speed as the web material 12, nips the web material 12 against the conveyor belt 16. Such a combination of the downstream over-speed nip formation between web separator 34 and conveyor belt 16 and the winding speed upstream nip formation between first winding spindle 24 and conveyor belt 16 causes the perforation disposed upon web material 12 located between the two nip points to break resulting in the formation of a final wound product 14 having the desired number of sheets of web material 12 disposed thereon resulting from the log associated with second winding spindle 26.

Alternatively, the web separator 34 can be provided with a surface speed lower than that of the surface speed of the conveyor belt 16 and the web material 12 cooperatively associated thereto. If the conveyor belt 16 is provided with a low coefficient of friction and the web separator 34 is provided with a surface speed lower than that of conveyor belt 16, the web separator 34 can decelerate the web material 12 at the nip point because the web material 12 slips relative to the conveyor belt 16 traveling at the desired web material 12 winding speed causing the perforation disposed between the web separator 34/conveyor belt 16 and second winding spindle 26/conveyor belt 16 nip points to break resulting in the formation of a final wound product 14 having the desired number of sheets of web material 12 disposed thereon resulting from the log associated with second winding spindle 26. Concurrent with such an under-speed nip formation between web separator 34 and conveyor belt 16, a succeeding new winding spindle 18 that will form the log associated with first winding spindle 24, traveling at the same surface speed as the web material 12, nips the web material 12 against the conveyor belt 16. That portion of web material 12 disposed beyond the nip formed between first winding spindle 24 and conveyor belt 16 can then be recalled and wound upon first winding spindle 24.

In yet still another embodiment, web separator 34 can be surface-speed matched with conveyor belt 16. In such an embodiment, web separator 34 is preferably provided with at least one blade that is inter-digitating and/or nestably related with a corresponding depression(s), groove(s), and/or blade (s), retractable or otherwise, disposed upon conveyor belt 16. It is believed that such inter-digitating and/or nestable blade assemblies known by those of skill in the art can be adapted to provide such a surface speed-matched web separator 34 assembly. By way of non-limiting example, the assemblies discussed in U.S. Pat. Nos. 4,919,351 and 5,335,869 can be adapted to provide such a surface speed-matched web separator 34 assembly suitable for use with the present invention.

The web material 12 disposed upon conveyor belt 16 upstream of the nip formed between web separator 34 and conveyor belt 16 is then transferred to a new winding spindle 18 which has had an adhesive disposed thereon. In a preferred embodiment, a core is disposed upon the new winding spindle 18 that is first winding spindle 24 and is held securely thereto. The winding turret 20 comprising the winding spindles 18 moves the first winding spindle 24 to the finish wind position, either intermittently or continuously, and the winding cycle is repeated. After the wind has been completed, the final wound product 14 is removed from first winding spindle 24 disposed upon turret assembly 20 and a new core is preferably disposed upon the now vacant winding spindle 18. Adhesive can then be applied to the new core prior to the web transfer. The winding sequence is then repeated as required.

As described previously, a preferred embodiment of the present invention includes winding the web material 12 on hollow cores for easier roll mounting and dispensing by the consumer. Additionally, the hybrid winder 10 of the instant invention provides for adjustable sheet length capability in order to provide format flexibility and sheet count control in increments of one for such format flexibility.

Further, the winding spindles 18 can be provided with a surface speed profile that can allow for enhanced winding capability of hybrid winder 10 as would be done by one of skill in the art. Such enhanced winding capability may be useful or even preferable with low-density substrates. Additionally, disposing conveyor belt 16 upon moveable first roller 28 and second roller 30 can provide for an adjustable contact position and/or force upon winding spindle 18 and web material 12 at the periphery of the log associated with second winding spindle 26. Thus, providing second winding spindle 26 with an adjustable rotational surface speed can provide for the ability to apply a force at the point where web material 12 is disposed upon second winding spindle 26 or any of the winding spindles 18. This process can provide for a final wound product 14 having the desired wind profile.

For example, final wound product 14 may be produced by a web material 12 having a perforated sheet length of 250 mm, a 100 sheet count, a finished roll diameter of 130 mm, and be wound upon a core having an outer diameter of 40 mm. Using this information, the theoretical average radial thickness for each layer of web material 12 comprising final wound product 14 can be calculated to be about 480 μm. In such an exemplary embodiment, the web material 12 may be provided with an initial (i.e., untensioned) thickness of 750 μm as web material 12 enters the winding area of hybrid winder 10. In order to provide for the above-described final wound product 14, if no contact exists between conveyor belt 16 and the log associated with a winding spindle 18, the web material 12 must be compressed from the initial thickness of 750 μm to the required theoretical target thickness of 480 μm by only the tension exerted by the winding spindle 18 speed on the incoming web material 12. Without desiring to be bound by theory, the calculated tension required to decrease the thickness of web material 12 from an initial 750 μm thickness to the required 480 μm thickness is about 500 grams per linear cm. However, one of skill in the art will appreciate that the web material 12 may separate uncontrollably at the perforations disposed within web material 12 when web material 12 is subject to such a tension (i.e., nominally greater than 350 grams per linear cm). Such uncontrolled separations can produce an unacceptable final wound product 14 and potentially result in line/production stoppages.

A process parameter that may be used to adjust the winding profile is log diameter measured at intervals throughout the winding process. The log diameter increases until the log is complete and a final log diameter may be obtained. It has been found that there is a strong correlation between the log winding speed, the winding tension, and the diameter of the log at various incremental points in the winding process. Such a system could be adapted to accurately measure log diameter and log diameter changes at one or more points during the winding process. For example, a log diameter control algorithm could compare the measured log diameter at a point in the process with a target value. The winding spindle 18 speed reference profile can then be adjusted with a Caliper Factor parameter to keep the log diameter at a target value. The present invention may maintain log diameter at any desired set point. If a process parameter measuring device shows that the diameter of a winding log is off the target value, a change could then be made to the reference profile. The reference profile change can then automatically yield small adjustments to the winding spindle 18 drive speed and thereby reduce the measured log diameter variation from the desired target log diameter value in the present or subsequent logs.

Other process parameter measurements that may be measured include log diameter, log diameter versus winding time, log diameter versus length of material on the log, or combinations thereof. These measurements may be used to determine what reference profile adjustments should be made. Those parameters may be adjusted by changing the caliper factor and/or the max line speed.

Additionally, the hybrid winder 10, as disclosed supra, may be utilized to provide supplemental compression of the web material 12 being wound upon a winding spindle 18 to produce final wound product 14. For example, the conveyor belt 16 may be loaded against the log associated with the winding spindle 18 by moving the position of first conveyor roller 28 and second conveyor roller 30 relative to a winding spindle 18 in order to achieve the desired final wound product 14. For example, the conveyor belt 16 may be loaded against a log disposed upon a winding spindle 18 with a force of 100 grams per linear cm. By calculation, it is believed that such a force may decrease the thickness of the web material 12 from a thickness of 750 μm to a thickness of 500 μm. The calculated required winding tension to further decrease the thickness of web material 12 from a thickness of 500 μm to the required thickness of 480 μm may be provided with as little as 40 grams per linear cm. This required tension level is well below the known, and assumed, perforation separation level of 350 grams per linear cm, thereby allowing reliable production of the desired final wound product 14.

Additionally, one of skill in the art will understand that the hybrid winder 10 disclosed herein can provide contact with the log associated with second winding spindle 26 through the entirety of the wind cycle. Thus, a final wound product 14 can be provided with heretofore unrealized wind uniformity throughout the entire final wound product 14. Further, one of skill in the art will realize that providing winding spindles 18 in a turret system 20 moving in a closed path can provide for continuous winding and removal of final wound product 14 without the need to interrupt the turret system 20 to load and unload winding spindles 18 or even the cores disposed upon winding spindles 18 from a moving turret system 20 mechanism.

In a preferred embodiment, the desired chop-off perforation disposed upon web material 12 is positioned within ½-inch (1.27 cm), more preferably within ¼-inch (0.64 cm), and most preferably within ⅛-inch (0.32 cm), of the transfer nip (formed between a new log and conveyor belt 16) and on the downstream side of the nip formed between a new log and conveyor belt 16. It is believed that this can minimize the portion of the sheet of web material 12 that extends beyond the transfer point onto the winding spindle 18 forming the new log. It is believed that this can reduce or eliminate the 'fold-back' typically associated with the prior art chop-off/transfer systems. It should be understood that such fold-back is typically associated with wrinkles on the core sheet forming final wound product 14 and are generally perceived as lower quality and can prohibit and/or inhibit consumers from using the first sheet disposed upon a core forming final wound product 14. Further, the web separator 34 can be registered with other features of the web material 12. This can include registration with embossing, perforations, other indicia, and the like, in either the machine and/or cross-machine directions. It is believed that this capability can be used to preferentially exert more or less contact force in desired areas of the web material 12 corresponding to other product properties. Such operations can be developed, and are fully intended within the scope of the present invention to avoid contact on a highly embossed area and may eventually preserve target aesthetics.

Alternatively, and as would be known to one of skill in the art, web separator 34 can be provided as a continuous belt configured to contact the web material 12 disposed upon conveyor belt 16 during a portion (i.e., intermittently), or the entirety (i.e., continuously), of the wind cycle. Such a continuous belt could be driven by a plurality of rollers that such a continuous belt is disposed upon. The rollers driving such a continuous belt can be provided with a momentary acceleration or deceleration in order to provide the force necessary to separate the web material 12 at the desired perforation as discussed supra. In an embodiment comprising an intermittently web-contacting conveyor web separator 34, the movement of the web separator 34 is timed such that the web separator 34 nips the web material 12 against the conveyor belt 16 when the perforation at the trailing end of the last desired sheet for the log associated with second winding spindle 26 is located between the first, or new, winding spindle 24 at the transfer position (i.e., at the web material 12 nip point) and the nip formed by the web separator 34 and conveyor belt 16. In either the intermittent or continuous web-contacting conveyor web separator 34 embodiment, combining a downstream, over-speed nip formation between web separator 34 and conveyor belt 16 and the winding speed, upstream nip formation between first winding spindle 24 and conveyor belt 16 can cause the perforation disposed upon web material 12 located between the two nip points to break resulting in the formation of a final wound product 14 having the desired number of sheets of web material 12 disposed thereon resulting from the log associated with second winding spindle 26. The web material 12 disposed upon conveyor belt 16 upstream of the nip formed between web separator 34 and conveyor belt 16 is then transferred to a new winding spindle 18 as described supra. It should be easily recognized by one of skill in the art that in any case, the intermittent or continuous web-contacting conveyor web separator 34 embodiments can be operatively associated with conveyor belt 16 with a surface speed that is either less than, the same as, or greater than, the surface speed of the conveyor belt 16 and the web material 12 cooperatively associated thereto. Modifications commensurate in scope with such embodiments to provide for any of the lower than-, greater than-, or equal to-surface speed embodiments of an intermittent or continuous web-contacting conveyor web separator 34 have been discussed supra.

The position of any driven and/or non-driven rollers in such a system could be controlled independently by linear actuators as would be known to one of skill in the art.

Such linear actuators could be controlled to provide the desired contact force and/or distance between the conveyor belt 16 and the continuous belt comprising web separator 34 at any point during the wind cycle. Linear actuators can also be controlled to regulate the final wound product 14 diameter by forcing the web substrate 12 into a desired or required target diameter at all points during the wind cycle.

In yet another embodiment, the web separator 34 can be provided with a permeable surface or any other type of surface that provides for the application of a substance from web separator 34 to the web material 12 either continuously (i.e., web separator 34 is in continuous contact with web material 12) or discontinuously (i.e., web separator 34 is in periodic contact with web material 12). In such an embodiment web separator 34 is preferably in fluid communication with a supply of substance sought to be disposed upon web material 12. Alternatively, such a permeable web separator 34 can be in fluid communication with a source of vacuum that facilitates the withdrawal or removal of moisture or debris from the surface of web material 12. It is believed that one of skill in the art would be able to adapt such a permeable roll to such a vacuum source in order to facilitate such removal of unwanted products, components, constituents, or debris, from the surface of web material 12. Yet still, web separator 34 can be heated and/or cooled, as would be done by one of skill in the art, in order to effectuate the positive benefits by the association of heat and/or cooling to the web material 12 in order to activate or control a desired process either on, or with, web material 12.

In use, the web material 12 disposed upon conveyor belt 16 is separated at an identified perforation by web separator 34. The web separator 34 provides for a nip, or pinch, of the web material 12 between an outer surface of web separator 34 and conveyor 16 proximate to the identified perforation. Concurrent with the separation of web material 12 at the identified perforation, first conveyor roller 28 supporting conveyor belt 16 is moveable along an exemplary axis A to facilitate compression of the leading edge of web material 12 against winding spindle 18 forming a new log.

In one preferred but non-limiting embodiment, the winding turret 20 is rotated in an intermittent and endless manner, wherein the individual winding spindles 18 are rotatably indexed about the winding turret axis 22 from one position to the next. In this embodiment, the leading edge of web material 12 may be compressed against winding spindle 18 to form a new log while the winding turret 20 is stationary. Alternatively, the leading edge of web material 12 may be compressed against winding spindle 18 to form a new log while the winding turret 20 is rotating. The start of formation of a new log may begin at any desired point in the rotation of winding turret 20 when any winding spindle 18 is adjacent to conveyor belt 16. Similarly, the start of formation of a new log may begin at any point in the interval in which the winding turret 20 is stationary when any of the winding spindles 18 are adjacent to conveyor belt 16.

In an alternative embodiment, the winding turret 20 is preferably rotated about winding turret axis 22 at a substantially constant angular velocity. In such an embodiment, the start of forming a new log may begin at any desired point in the rotation of winding turret 20 when any winding spindle 18 disposed on winding turret 20 is adjacent to conveyor belt 16.

In a preferred embodiment, each winding spindle 18 is provided with a core having an adhesive disposed upon the surface thereof to facilitate attachment of the leading edge of web material 12 to the respective winding spindle 18. Further, the remaining web material 12 attached to winding spindle 18 forming an old log continues to be disposed thereon. Second conveyor roller 30 and/or pressure assist device 32 supporting conveyor belt 16 are moveable (either jointly or severally) about exemplary axis B in order to provide for a desired pressure to be exerted by pressure assist device 32 and conveyor belt 16 upon the old log having web material 12 disposed thereon by conveyor belt 16. It is in this manner that the old log can be provided with a desired wind profile during the entirety of the winding process.

As web material 12 is being disposed upon winding spindle 18 to form a new log, the new log 40 progresses from a first initial contact position to a final log winding position. Concurrent with new log growth upon winding spindle 18, the speed at which winding spindle 18 turns is preferably adjusted to maintain a matched surface speed of the new log with incoming web material 12 disposed upon conveyor belt 16. Additionally, axis A of first conveyor roller 28 and axis B of second conveyor roller 30 along with pressure assist device 32 can be adjusted in order to provide the desired pressure of pressure assist device 32 and conveyor belt 16 upon the new log as the diameter of the new log increases radially due to the continued deposition of web material 12 thereupon. Concurrent with the movement of the new log toward a final wind position, web separator 34 is preferably positioned away from the region of nip formation between the tip of web separator 34 and conveyor belt 16. Preferably, the old log disposed upon a winding spindle 18 is now positioned so that the old log can be removed from turret assembly 20 and a new core, if required, can be disposed upon the winding spindle 18 previously occupied by the old log.

As the new log progresses to a final wind position, a new winding spindle 18 is positioned proximate to the initial loading stage and prepared for reception of web material 12 upon separation by web separator 34. As required, the position of second conveyor roller 30 and pressure assist device 32 (either jointly or severally) can be adjusted along axis B, either with or without adjustment of the position of first conveyor roller 28 and pressure assist device (either jointly or severally) along axis A, in order to provide the desired surface pressure of pressure assist device 32 and conveyor belt 16 upon the new log in order to provide for the desired winding profile. As the new log progresses orbitally about winding turret axis 22 of turret assembly 20, the old log having web material 12 disposed thereupon can be prepared for removal from turret assembly 20 as finally wound product 14.

In a preferred embodiment, the desired chop-off perforation disposed upon web material 12 is positioned within ½-inch (1.27 cm), more preferably within ¼-inch (0.64 cm), and most preferably within ⅛-inch (0.32 cm), of the transfer nip (formed between the new log and conveyor belt 16) and on the downstream side of the nip formed between the new log and conveyor belt 16. It is believed that this can minimize the portion of the sheet of web material 12 that extends beyond the transfer point onto the winding spindle 18 forming a second new log. It is believed that this can reduce or eliminate the 'fold-back' typically associated with the prior art chop-off/transfer systems. It should be understood that such fold-back is typically associated with wrinkles on the core sheet forming final wound product 14 and are generally perceived as lower quality and can prohibit and/or inhibit consumers from using the first sheet disposed upon a core forming final wound product 14. Further, the web separator 34 can be registered with other features of the web material 12. This can include registration with embossing, perforations, other indicia, and the like, in either the machine and/or cross-machine directions. It is believed that this capability can be used to preferentially exert more or less contact force in desired areas of the web material 12 corresponding to other product properties. Such operations can be developed, and are fully intended within the scope of the present invention to avoid contact on a highly embossed area and may eventually preserve target aesthetics.

Alternatively, and as would be known to one of skill in the art, web separator 34 can be provided as a continuous belt configured to contact the web material 12 disposed upon conveyor belt 16 during a portion (i.e., intermittently), or the entirety (i.e., continuously), of the wind cycle. Such a continuous belt could be driven by a plurality of rollers that such a continuous belt is disposed upon. The rollers driving such a continuous belt can be provided with a momentary acceleration or deceleration in order to provide the force necessary to separate the web material 12 at the desired perforation as discussed supra. In an embodiment comprising an intermittently web-contacting conveyor web separator 34, the movement of the web separator 34 is timed such that the web separator 34 nips the web material 12 against the conveyor belt 16 when the perforation at the trailing end of the last desired sheet for the log associated with second winding spindle 26 is located between the first, or new, winding spindle 24 at the transfer position (i.e., at the web material 12 nip point) and the nip formed by the web separator 34 and conveyor belt 16. In either the intermittent or continuous web-contacting conveyor web separator 34 embodiment, combining a downstream, over-speed nip formation between web separator 34 and conveyor belt 16 and the winding speed, upstream nip formation between first winding spindle 24 and conveyor belt 16 can cause the perforation disposed upon web material 12 located between the two nip points to break resulting in the formation of a final wound product 14 having the desired number of sheets of web material 12 disposed thereon resulting from the log associated with second winding spindle 26. The web material 12 disposed upon conveyor belt 16 upstream of the nip formed between web separator 34 and conveyor belt 16 is then transferred to a new winding spindle 18 as described supra. It should be easily recognized by one of skill in the art that in any case, the intermittent or continuous web-contacting conveyor web separator 34 embodiments can be operatively associated with conveyor belt 16 with a surface speed that is either less than, the same as, or greater than, the surface speed of the conveyor belt 16 and the web material 12 cooperatively associated thereto. Modifications commensurate in scope with such embodiments to provide for any of the lower than-, greater than-, or equal to-surface speed embodiments of an intermittent or continuous web-contacting conveyor web separator 34 have been discussed supra.

The position of any driven and/or non-driven rollers in such a system could be controlled independently by linear actuators as would be known to one of skill in the art. Such linear actuators could be controlled to provide the desired contact force and/or distance between the conveyor belt 16 and the continuous belt comprising web separator 34 at any point during the wind cycle. Linear actuators can also be controlled to regulate the final wound product 14 diameter by forcing the web substrate 12 into a desired or required target diameter at all points during the wind cycle.

In yet another embodiment, the web separator 34 can be provided with a permeable surface or any other type of surface that provides for the application of a substance from web separator 34 to the web material 12 either continuously (i.e., web separator 34 is in continuous contact with web material 12) or discontinuously (i.e., web separator 34 is in periodic contact with web material 12). In such an embodiment web separator 34 is preferably in fluid communication with a supply of substance sought to be disposed upon web material 12. Such a substance could be suitable for use as a tail bonding glue. If desired, the substance can be suitable for use in applying an indicium and/or indicia upon web material 12.

The dimensions and values disclosed herein are not to be understood as being strictly limited to the exact dimensions and values recited. Instead, unless otherwise specified, each such dimension and/or value is intended to mean both the recited dimension and/or value and a functionally equivalent range surrounding that dimension and/or value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for rewinding a web material, said method comprising the steps of:

providing a conveyor belt having opposed first and second surfaces;

providing a pressure assist device proximate to said second surface of said conveyor belt;

disposing said web material on said first surface of said conveyor belt;

providing at least one winding spindle having a speed profile proximate to said web material disposed upon said first surface of said conveyor belt;

adjusting a position of at least one of said conveyor belt and said pressure assist device relative to said winding spindle in order to provide a compressive force to the surface of said winding spindle by said conveyor belt;

adjusting a speed of said at least one winding spindle according to said speed profile; and, transferring said web material to said at least one winding spindle from said conveyor belt.

2. The method according to claim 1 further comprising the step of operatively associating said winding spindle with a winding turret.

3. The method according to claim 2 further comprising the step of operatively associating a plurality of winding spindles with said winding turret.

4. The method according to claim 3 further comprising the step of sequentially positioning each of said plurality of winding spindles proximate to said web material disposed upon said conveyor belt and transferring said web material to each of said winding spindles.

5. The method according to claim 1 further comprising the step of indexing said winding spindle from a first winding position proximate said conveyor belt to a second winding position proximate said conveyor belt.

6. The method according to claim 1 further comprising the step of disposing a core about said winding spindle and transferring said web material to said core when said winding spindle is proximate said conveyor belt and said web material disposed thereon.

7. The method according to claim 1 further comprising the step of perforating said web material.

8. The method according to claim 1 further comprising the step of providing a web separator, said web separator being adapted to periodically pinch said web material between web separator and said conveyor belt.

9. The method according to claim 8 further comprising the step of providing said conveyor belt with a low coefficient of friction.

10. The method according to claim 8 further comprising the step of providing said web separator with a surface speed that is greater than a surface speed of said conveyor.

11. The method according to claim 1 wherein said compressive force provided to the surface of said winding spindle by said conveyor belt is applied to said winding spindle at a tangent point of contact between said winding spindle and said conveyor belt.

12. A method for winding web material, said method comprising the steps of:

providing a conveyor belt, said conveyor belt having opposed first and second surfaces;

providing a pressure assist device proximate to said second surface of said conveyor belt;

providing a first winding spindle having a speed profile adjacent to said first surface of said conveyor belt;

transferring said web material to said first surface of said conveyor belt;

adjusting a position of at least one of said conveyor belt and said pressure assist device relative to said winding spindle in order to provide a compressive force to the surface of said winding spindle by said conveyor belt;

subsequently transferring said web material from said first surface of said conveyor belt to said first winding spindle;

adjusting the speed of said first winding spindle according to said speed profile; and, disposing said web material upon said first winding spindle to produce a finally wound product.

13. A method according to claim 12 further comprising the step of perforating said web material.

14. A method according to claim 13 further comprising the step of separating said web material at a perforation separating adjoining pieces of said web material.

15. A method according to claim 13 wherein said step of separating said web material further comprises the step of providing a separation device for separating said web material, said separation device having a surface speed that is faster than a speed of said web material.

16. A method according to claim 12 further comprising the step of progressing said first winding spindle from a first winding position to a second winding position when said web material is being disposed upon said first winding spindle.

17. A method according to claim 12 further comprising the step of cooperatively associating said first winding spindle with a winding turret.

18. A method for converting a web material into a wound roll, the method comprising the steps of:

providing a conveyor belt having a first surface and a second surface opposed thereto;

providing a pressure assist device in contacting engagement with said second surface of said conveyor belt;

depositing said web material onto said first surface of said conveyor belt;

moving said web material deposited upon said first surface of said conveyor belt proximate to a winding spindle having a speed profile;

adjusting a position of at least one of said conveyor belt and said pressure assist device relative to said winding spindle in order to provide a compressive force to the surface of said winding spindle by said first surface of said conveyor belt;

rotating said winding spindle according to said speed profile; and, transferring said web material from said first surface of said conveyor belt to said winding spindle.

* * * * *